United States Patent [19]

Little

[11] Patent Number: 4,739,456

[45] Date of Patent: Apr. 19, 1988

[54] HIGH INTENSITY PATTERN/FOLLOW SPOT PROJECTOR

[76] Inventor: William D. Little, P.O. Box 20211, Dallas, Tex. 75220

[21] Appl. No.: 940,849

[22] Filed: Dec. 12, 1986

[51] Int. Cl.[4] ..... F21V 13/04

[52] U.S. Cl. ..... 362/268; 362/289; 362/308; 362/296

[58] Field of Search ..... 362/268, 285, 289, 307, 362/308, 296

[56] References Cited

U.S. PATENT DOCUMENTS

| | | | |
|---|---|---|---|
| 2,055,217 | 9/1936 | Gauthier | 88/24 |
| 2,129,676 | 9/1938 | Creehan | 240/41.35 |
| 2,391,430 | 12/1945 | Macek | 88/24 |
| 2,503,500 | 4/1950 | Lowry | 240/41.3 |
| 3,735,125 | 5/1973 | Wilms | 240/41.3 |
| 3,768,900 | 10/1923 | McLintic | 362/308 |
| 4,232,359 | 11/1980 | Leon | 362/268 |
| 4,519,020 | 5/1985 | Little | 362/268 |
| 4,523,257 | 6/1985 | Mori | 362/32 |

*Primary Examiner*—Albert W. Davis, Jr.
*Attorney, Agent, or Firm*—Dennis T. Griggs

[57] ABSTRACT

In a spot projector having a reflector, a coiled filament lamp, a gate and a lens, improved light output efficiency is provided by locating the virtual filament center intermediate the reflector and the natural focus of the reflector. The gate is provided with an aperture which is substantially equal to or larger than the aperture of the reflector to accomodate the divergence of light rays produced by locating the filament to the rear of the focus point. Because the distribution of the light rays which emanate from the filament approximates a cosine distribution, and because the location of the virtual filament is behind the actual focus point, the percentage of light rays which are projected transversely through a region between the reflector and the gate is substantially reduced, and a correspondingly greater amount of filament illumination is reflected through the gate aperture, thereby producing a brighter image than would be produced by the same lamp located forward of the focus.

2 Claims, 2 Drawing Sheets

HIGH INTENSITY PATTERN/FOLLOW SPOT PROJECTOR

FIELD OF THE INVENTION

This invention relates generally to light projection apparatus, and in particular to a spot projector of the type suitable for stage lighting and studio lighting applications.

BACKGROUND OF THE INVENTION

Conventional illumination systems, especially for soft lighting or spot flooding applications, are somewhat inefficient and complex. For stage and studio lighting applications, the spot projectors must be adapted to vary the area of illumination to accomodate different stage settings. The low efficiency of conventional projectors used for this purpose usually requires multiple projectors to produce a desired level of illumination.

DESCRIPTION OF THE PRIOR ART

Equipment for stage and studio lighting has undergone significant changes over the last 50 years. Early designs for plano-convex spotlights included a lamp, a plano-convex lens and a paraboloidal reflector. These conventional units have been replaced by spotlights having fresnel lenses and ellipsoidal reflectors. The advances in these units have been primarily in mounting construction, rather than optics and efficiency.

In the early development of ellipsoidal spotlights, only two sizes were in common use: a 250-500-750 watt unit with two 6-inch diameter by 9-inch focal length lenses mounted together and movable as a single lens for focusing, and an 8-inch diameter by 12-inch focal length lens unit using 1000-1500-2000 watt lamps. Usage of the 8-inch diameter units has, for the most part, been discontinued. The most commonly used ellipsoidal units at the present include 3½-inch, 4½-inch, 6-inch, 10-inch, 12-inch and 14-inch lens diameter units with a power rating of 300–1000 watts.

The stage lighting and studio lighting trades have favored the ellipsoidal reflector spotlights, sometimes referred to as pattern spotlights. These units have traditionally used tubular, incandescent or tungsten-halogen lamps. The technology of lighting design has become more and more dependent upon the output characteristics of various lamp/reflector combinations.

In photometric tests of such units, it has been determined that efficiences of about 30% can be obtained for units having a good match between the lamp and the reflector, and for the narrower, physically larger units, the efficiences drop to as little as 15%–20%.

In prior art spot projector arrangements, the reflector aperture is larger than the gate aperture, and the virtual location of the lamp filament is forward of the reflector focus. See, for example, my prior U.S. Pat. No. 4,519,020 in which the diameter of the gate aperture is smaller than the reflector aperture. The lamp filament does not radiate light as a point source, but instead radiates light substantially transverse to the optical axis in a pattern approximately a cosine distribution. Because of such non-linear distribution, a substantial percentage of the light output is unused in the sense that it is projected transversely across the optical axis through a region between the reflector and the gate, and is not reflected through the lens. It will be appreciated that the light output of the projector assembly could be increased substantially by redirecting the unused portion of the filament output.

Conventional reflector/lamp combinations use reflectors which are characterized by a deep reflector surface having a complex curvature, for example an ellipsoid of revolution, and having a focus location which is near the reflector surface. In such reflectors, the coiled filament lamp is located forward of the reflector focus. Since the virtual filament center does not coincide with the focus, the reflected light rays are projected along converging paths. As result of such convergence, the gate aperture must be smaller than the reflector aperture. In such small gate arrangements the light output in the desired direction parallel with the projection axis will be reduced by scattering of the rays transversely through a region between the reflector and the gate. It will be appreciated that the light output of such a projector could be increased by redirecting the unused portion of the filament output.

There is a continuing interest in improving the illumination efficiency of spot projectors, thereby reducing the overall number of projectors required for a given soft lighting or spot flooding application, and further reducing the operating power requirements.

OBJECTS OF THE INVENTION

The general object of this invention is to provide an economical and versatile spotlight which is capable of high-efficiency performance and which uses commonly-available lenses and reflectors.

A related object of the invention is to provide a high-efficiency spot projector which is capable of producing a predetermined level of illumination with a lamp having relatively low power consumption.

A related object of the invention is to provide a high-efficiency spot projector which is capable of producing a specific level of illumination while dissipating less heat.

Still another object of this invention is to provide an improved spot projector having an optical train including a lamp, a reflector, a gate, and one or more lenses.

SUMMARY OF THE INVENTION

Increased output is provided by the present invention by using a reflector having an effective output aperture which is preferably smaller than or equal to the gate aperture, and by positioning the lamp to a location along the focal axis so that its virtual filament center lies to the rear of the actual focus location of the reflector. As a result of shifting the virtual filament location immediately behind the reflector focus location, the light rays are scattered in a pattern which diverges away from the optical axis. Because the distribution of the light rays which emanate from the filament approximates a cosine distribution, and because the location of the virtual filament is behind the actual focus location, the percentage of light rays which are projected transversely through a region between the reflector and the gate is substantially reduced. That is, the amount of unreflected filament output is substantially reduced, the effective gate aperture is increased, and a correspondingly greater amount of filament illumination is reflected through the gate to the lens, thereby producing a brighter image than would be produced by the same lamp located forward of the reflector focus.

Operational features and advantages of the present invention will be appreciated by those skilled in the art upon reading the detailed description which follows in connection with the attached drawings.

DETAILED DESCRIPTION OF THE PREFERRED EMBODIMENT

Figure 1:
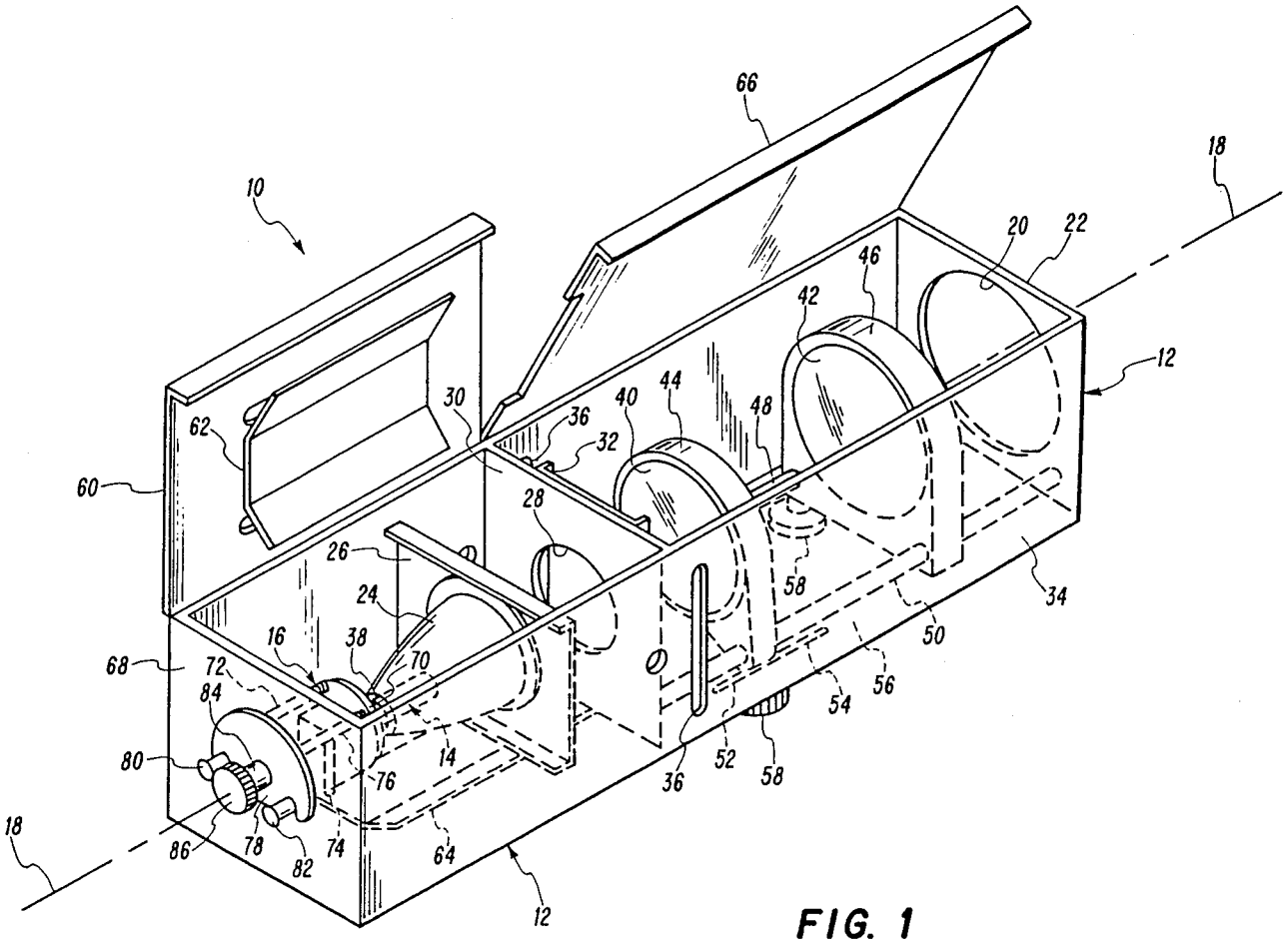
FIG. 1 is a partially open, perspective view of a spotlight constructed in accordance with the teachings of the present invention.

In the description which follows, like parts are marked throughout the specification and drawings with the same reference numerals, respectively. The drawings are not necessarily to scale, and in some instances, proportions have been exaggerated in order to more clearly depict certain features of the invention.

Referring now to FIG. 1, a spotlight projector 10 includes a housing 12 of rectangular cross section. A lamp 14 mounted on an adjustable support assembly 16 produces a high intensity light beam which is projected along an optical axis 18 through a housing aperture 20 formed in a front panel 22 of the housing. A color filter (not illustrated) can be installed onto the front panel 22 over the projection aperture 20, as desired.

The lamp 14 is enclosed within a deep reflector 24 which is held in axial alignment with the optical axis 18 by a mounting bracket 26. Light rays X (FIG. 2) emanating from the lamp 14 are projected through a circular aperture 28 formed in a gate plate 30. The gate aperture diameter is determined by the reflector curvature, size and surface finish. A template holder 32 is attached to the gate plate 30 forwardly of the gate aperture 28 for receiving one or more spot pattern framing shutters as desired. The housing 12 includes a side panel 34 formed with a slot 36 through which a framing shutter can be inserted. The other side panels of the housing 12 are also provided with slots or notches for this purpose.

The reflector 24 illustrated in FIG. 1 is preferably ellipsoidal, but may be any other convex surface of revolution such as paraboloidal or spherical. The reflector 20 has a rear access opening 38 for receiving the lamp 14. The light beam X reflected by the reflector 24 is focused along the optical axis 18 by a focusing lens 40 having a diameter and focal length which bears a particular relationship to the diameter and focal length of an objective lens 42. The focusing lens 40 and the objective lens 42 are each concentrically aligned with the optical axis 18 by annular lens carrier frames 44, 46, respectively. The lens carrier frames 44, 46 are slidably mounted onto parallel slider bars 48, 50.

The axial location of each lens relative to the gate aperture 28 is manually adjustable by movement of each lens along the slider bars 48, 50. Each lens carrier includes a threaded fitting 52 projecting through an elongated slot 54 which is formed in the base panel 56 of the housing 12. Each lens carrier is secured in place by a threaded knob 58 which is torqued against the base panel 48 and onto the threaded fitting 52. Each lens carrier can be moved axially along the slider bars by loosening the knob 58 and pushing or pulling against the knob while observing the projected spot until the desired effect is produced.

Access to the reflector 24 is provided by a hinged panel 60 which is pivotally mounted onto the housing 12 and is located directly above the lamp and reflector assembly. An upper radiation shield 62 is mounted onto the underside of the panel 60, and a lower radiation shield 64 is mounted onto the inside surface of the base panel 56. Ventilation openings (not illustrated) are provided in the housing 12 in the usual manner. Likewise, access to the lens compartment is provided by a hinged panel 66. It should be understood that the hinged panels 60, 66 are provided for maintenance and repair purposes, and for insertion of framing shutters, pattern grids and color filters during initial set-up.

The distribution of the reflected light flux energy is important in the operation of the spotlight projector 10. Adjustment of the lamp position within the reflector 24 varies the projected beam distribution from a central peak pattern to a flat field pattern. Axial position of the lamp 14 along the focal axis 18 to a location to the rear of the reflector focus F (FIG. 3) is provided by the lamp support assembly 16 which is mounted onto the back panel 68 of the housing 12.

The lamp support assembly 16 includes a carriage plate 70 which is mounted for sliding movement along three support posts 72, 74 and 76. The lamp 14 is secured within a lamp socket mounted onto the carriage plate 70. The carriage plate 70 is biased for movement away from the back panel 68 by compression springs which are coiled around the support posts 72, 74 and 76, respectively. The support posts are stabilized by a mounting plate 78 which is secured onto the back plate 68 by mounting fasteners 80, 82. Power conductors (not illustrated) are connected to the lamp socket and are routed through the mounting panel 78. According to this arrangement, the entire lamp support assembly 16 can be removed for inspection, repair or replacement by releasing the fasteners 80, 82 and withdrawing the entire lamp support assembly.

Figure 3:
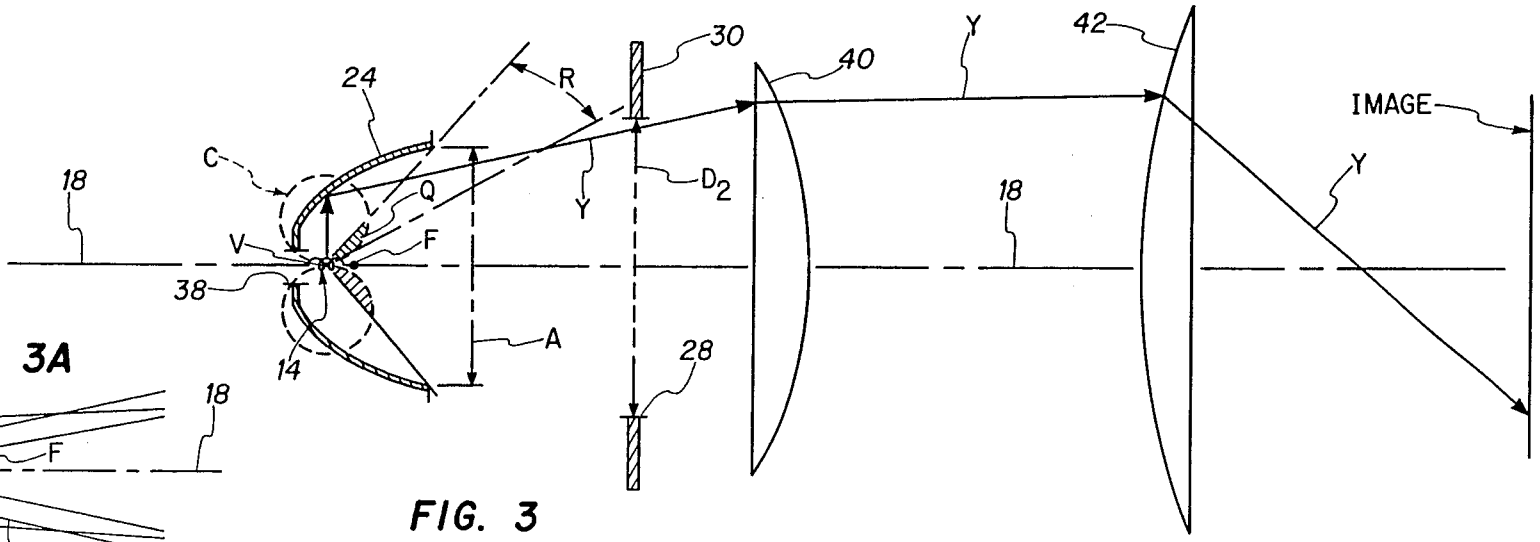
FIG. 3 is a view similar to FIG. 2 in which the virtual center of the lamp filament is located behind the reflector focus; and, FIG. 3A is a diagram which illustrates the diverging pattern of light rays as reflected in the rear filament arrangement shown in FIG. 3.

The axial position of the lamp 14 is adjustable in the region between the reflector and the focus point F by a threaded adjustment shaft 84 which projects through the mounting plate 78 and is received in threaded engagement with the lamp socket carriage plate 70. A knob 86 attached to the threaded shaft 84 permits easy adjustment of the lamp position in response to rotation of the knob. By adjusting the axial position of the lamp 14, flat and peak fields can be created, and the beam angle can be varied. This adjustment feature also permits the operator to compensate for lamp filament variations and lamps of different brands and types, so that the virtual filament center V is positioned to the rear of the reflector focus F, as shown in FIG. 3.

Figure 2:
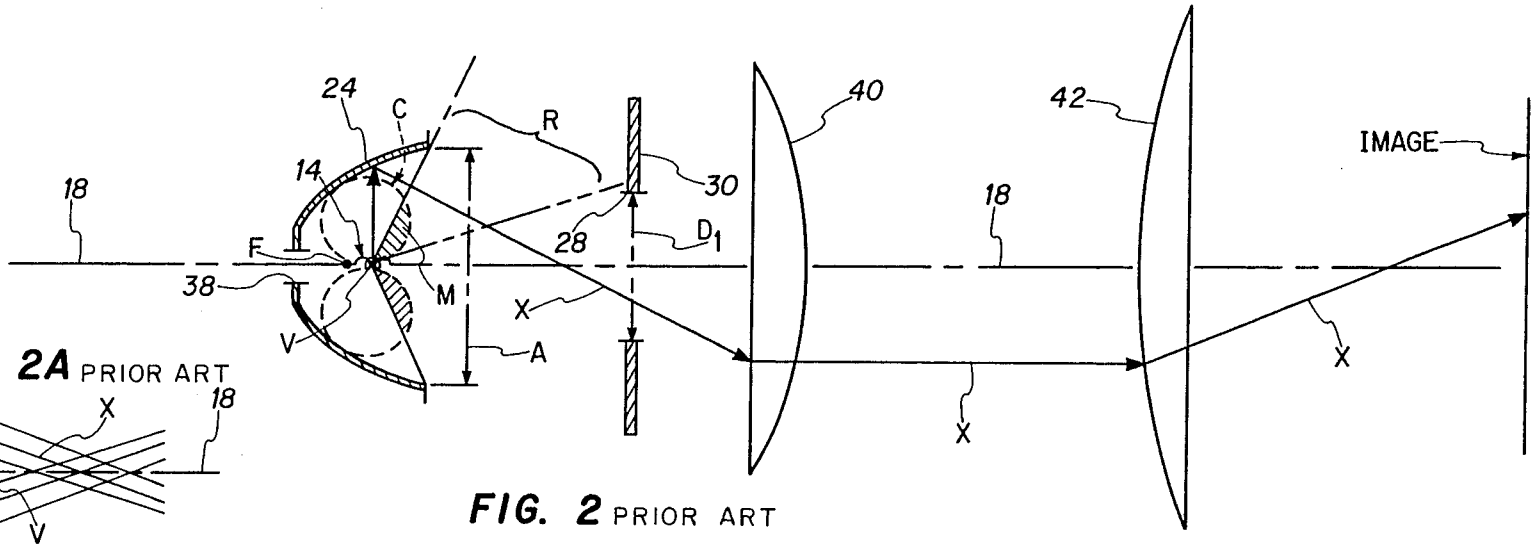
FIG. 2 PRIOR ART
FIG. 2 is a simplified diagram of a reflector, lamp and lens system in which the lamp filament is located forwardly of the reflector focus.
Figure 2A:
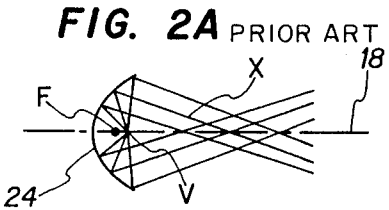
FIG. 2A PRIOR ART
FIG. 2A is a diagram which illustrates the converging pattern of light rays reflected in the forward filament, deep reflector arrangement of FIG. 1.

The lamp, reflector and lens arrangement as shown schematically in FIG. 2 is typical of conventional spot projectors. In this arrangement, the virtual location V of the lamp filament 14 is located forwardly of the focus F with the result that light rays reflected by the reflector 24 are directed transversely with respect to the optical axis 18 in a converging pattern, substantially as depicted in FIG. 2A. In this arrangement, the diameter D of the gate aperture 28 is smaller than the output aperture A of the reflector 24.

By inspection of FIG. 2, the distribution of light emanating from the coiled filament 14 approximates a cosine distribution C with respect to the virtual filament center V. The shaded region M represents the unused light output which is directed transversely through a region R between the reflector and the gate plate 30.

The light rays X which emanate from the coiled filament 14 through the flux region R are not reflected but are instead absorbed and scattered by the gate plate 30 and by the housing 12. The unused portion of the filament radiation is not reflected by the reflector 24, and is not projected through the gate aperture 28. Accordingly, such light output is wasted, thereby reducing the illumination efficiency of the projector assembly.

It will be appreciated that the light output of the projector assembly 10 will be increased by redirecting some of the unused filament output M through the gate aperture 28. The unused filament output M is substantially reduced to a lower output value Q by the arrangement as shown in FIG. 3. The unused portion Q of the cosine light distribution C is appreciably less than the corresponding unused portion M as depicted in FIG. 2. A smaller unused light flux portion Q is achieved, along with a corresponding increase in illumination efficiency in the arrangement of FIG. 3, as a result of (a) locating the lamp filament 14 to the rear of the focus point F, that is, at a location along the optical axis 18 intermediate the reflector focus F and the reflector surface 24; and, (b) providing a gate aperture 28 having a diameter $D_2$ which is equal to or greater than the effective diameter of the reflector aperture A of the arrangement as shown in FIG. 3. In the arrangement of FIG. 2, the gate diameter $D_1$ is smaller than the reflector aperture A. In contrast, in the improved arrangement as shown in FIG. 3, the gate aperture $D_2$ is greater than the reflector aperture A.

A smaller gate diameter $D_1$ is required for the arrangement shown in FIG. 2 because the position of the lamp filament 14 forward of the reflector focus point F causes the light rays X to be reflected in a converging pattern as shown in FIG. 2A. Because of the convergence of the rays X, a smaller gate diameter $D_1$ is needed so that a particular outline or specific pattern can be imposed upon the projected light.

Figure 3A:
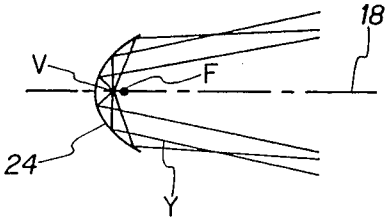

In the arrangement shown in FIG. 3, however, the virtual center V of the coiled filament 14 is positioned behind the focus point F at a location along the focal axis 18 so that the light rays Y are reflected along a divergent pattern which is transverse with respect to the optical axis 18 as indicated in FIG. 3A. One advantage of the divergent pattern established by the configuration of FIG. 3 is that a relatively smaller percentage of the unused light output Q is produced by the reflector 88. That is, most of the cosine distribution C is directed onto the curved reflecting surface of the reflector 88, so that is reflected through the gate aperture 28. Because the light rays Y are diverging transversely with respect to the optical axis 18, the diameter $D_2$ of the gate aperture 28 must be larger than the aperture A of the reflector 24, to accomodate the diverging rays.

With the relatively large gate diameter $D_2$, and with the virtual filament center V located to the rear of the natural focus F, appreciably more of the cosine light distribution C is reflected through the gate aperture. Operational tests of a spot projector having the reflector, filament and gate arrangement as shown in FIG. 3 have produced efficiences in the range of 52% to 64% as compared with efficiencies of only 15% to 30% in a spot projector configured according to a conventional reflector, filament and gate arrangement as shown in FIG. 2.

It will be seen that the configuration of FIG. 3 uses commonly-available components, but with the geometry of the reflector, the diameter of the gate aperture and the location of the virtual filament center being selected to produce a slightly diverging reflected light pattern, whereby the unused portion of the light emanating from the coiled filament is substantially reduced, and a correspondingly larger portion of the cosine light distribution being reflected through the relatively large diameter gate aperture. Because of the improved light output efficiency, a predetermined level of illumination can be provided by a lamp having a relatively lower power consumption as compared with the lamp size required to produce a corresponding light output level in a conventional projector. Because a lamp having a lower power rating can be used to produce a given illumination level, the spot projector will produce a specific level of illumination while dissipating less heat.

Although the invention has been described with reference to a specific embodiment, and with reference to a specific spot projector assembly, the foregoing description is not intended to be construed in a limiting sense. Various modifications of the disclosed embodiment as well as alternative applications of the invention will be suggested to persons skilled in the art by the foregoing specification and illustrations. It is therefore contemplated that the appended claims will cover any such modifications or embodiments that fall within the true scope of the invention.

What is claimed is:

1. An optical projector for projecting light produced by a lamp comprising, in combination:

a projector housing having an open end through which light may be projected along an optical axis;

a reflector received within said housing and having an output aperture through which light is reflected, said reflector having a reflecting surface and a focus point substantially in alignment with said optical axis;

a lamp disposed within said reflector, said lamp having a filament virtual center disposed between the focus point of said reflector and the reflecting surface of said reflector;

a lens mounted on the optical axis through which light from said lamp passes and is projected out said open end of said projector housing; and a gate having a gate aperture interposed between said reflector and said lens; the size of said gate aperture being substantially equal to or greater than the size of the output aperture of said reflector.

2. A method for operating a light projector assembly of the type including a gate and means for projecting a beam of light through said gate including a reflector and a light source disposed within said reflector, and a lens disposed in the path of the light beam, comprising the steps of positioning the light source intermediate the reflector and its focus point, reflecting the light emanating from the light source through a gate having an aperture size substantially equal to or greater than the aperture size of said reflector, and thereafter directing the reflected light through said lens.

* * * * *

UNITED STATES PATENT AND TRADEMARK OFFICE

CERTIFICATE OF CORRECTION

PATENT NO. : 4,739,456

DATED : 4/19/88

INVENTOR(S) : William D. Little

It is certified that error appears in the above-identified patent and that said Letters Patent is hereby corrected as shown below:

Column 1, line 50, "efficiences" should be -- efficiencies --.

Column 1, line 53, "efficiences" should be -- efficiencies --.

Column 1, line 62, "approximately" should be -- approximating --.

Column 5, line 67, "efficiences" should be -- efficiencies --.

Signed and Sealed this

Second Day of August, 1988

*Attest:*

DONALD J. QUIGG

*Attesting Officer*

*Commissioner of Patents and Trademarks*